United States Patent [19]

Bean et al.

[11] 4,076,528

[45] Feb. 28, 1978

[54] XEROGRAPHIC BINDER PLATE

[75] Inventors: Lloyd F. Bean, Rochester; Robert W. Gundlach, Victor, both of N.Y.

[73] Assignee: Xerox Corporation, Stamford, Conn.

[21] Appl. No.: 567,956

[22] Filed: Apr. 14, 1975

Related U.S. Application Data

[63] Continuation of Ser. No. 350,667, May 12, 1973, abandoned, which is a continuation-in-part of Ser. No. 94,072, Dec. 1, 1970, abandoned.

[51] Int. Cl.[2] ..... G03G 5/02; G03G 5/06

[52] U.S. Cl. ..... 96/105 R; 96/1.7

[58] Field of Search ..... 96/1.5, 1.7

[56] References Cited

U.S. PATENT DOCUMENTS

| | | | |
|---|---|---|---|
| 3,037,861 | 6/1962 | Hoegl et al. | 96/1.5 |
| 3,871,880 | 3/1975 | Montillier | 96/1.5 |
| 3,894,868 | 7/1975 | Regensburger | 96/1.5 |

*Primary Examiner*—David Klein
*Assistant Examiner*—John L. Goodrow
*Attorney, Agent, or Firm*—James J. Ralabate; James P. O'Sullivan; Ronald L. Lyons

[57] ABSTRACT

A photoconductive member for xerographic applications comprising a mixture of particles of at least two photoconductive pigments capable of generating and injecting holes and electrons dispersed in an insulating binder, capable of transporting holes and electrons in response to imagewise radiation. The photoconductors which are preferred also have a coefficient of absorption between 1/L and 8/L wherein L is the thickness of the photoconductive member in microns. The photoconductive member thus formed is capable of continuous tone reproduction and has improved xerographic characteristics. In a particularly preferred embodiment, one of the photoconductive materials is cadmium sulfoselenide.

9 Claims, 3 Drawing Figures

XEROGRAPHIC BINDER PLATE

BACKGROUND OF THE INVENTION

This application is a continuation of copending application Ser. No. 350,667, filed Apr. 12, 1973 now abandoned, which is a continuation-in-part of application Ser. No. 94,072, filed Dec. 1, 1970 now abandoned.

This invention relates generally to imaging and in particular to a new photoconductive insulating material exhibiting surprising and advantageous characteristics when used as a photoconductor layer in xerographic plates in the process of xerography.

In the process of xerography, for example, as described in Carlson U.S. Pat. No. 2,297,691, a xerographic plate comprising a layer of photoconductive insulating material on a conductive backing is given a uniform electric charge over its surface and is then exposed to a light and shadow image pattern of the subject matter, the original to be reproduced, usually by conventional projection techniques. This exposure discharges the plate areas in accordance with the radiation intensity that reaches them and thereby creates an electrostatic latent image on or in the photoconductive layer corresponding to the light and shadow image pattern. Development of the latent image is effected by an electrostatically charged, finely divided material such as electroscopic powder, termed "toner" that is brought into surface contact with the photoconductive layer and is held thereon electrostatically in a pattern corresponding to the electrostatic latent image. The developed toner image may be fixed or made permanent on the xerographic plate itself. Alternatively, if it is desired to apply the developed xerographic image to paper, metal, foil, plastic film or other transfer material, the developed image may be transferred from the xerographic plate to such a support surface to which it may be affixed by any suitable means. Although many photoconductive insulating materials have been disclosed to be useful in the process of xerography, selenium in its amorphous form has been the preferred material for use in commercial xerographic equipment because of its extremely high quality image capability, relatively high light response and capability to receive and retain charge areas at different potentials and because of its capability of repetitive use for many cycles and at high cycling rates for image reproduction.

Although amorphous selenium is by far the most extensively used photoconductive insulating material in commercially available xerographic machines employing reusable xerographic plates, amorphous selenium has certain characteristics which have prompted those skilled in the art to search for alternative materials. For example, amorphous selenium is sensitive only to radiation of wavelengths shorter than about 580 nanometers. In addition, xerographic plates made with amorphous selenium are expensive to manufacture since the selenium itself is expensive and must be applied to the supporting substrate by vacuum evaporation under highly controlled temperature and other conditions, for exampled, as illustrated in Keck U.S. Pat. No. 2,739,079. Also, amorphous selenium layers are only meta-stable because they are readily recrystallized into inoperative hexagonal crystallized forms at temperatures only slightly in excess of those prevailing in conventional xerographic copy machines. Also, the surface of an amorphous selenium photoconductor layer is relatively soft and easily abraded which results in deterioration of the plate surface and subsequently, of image quality.

In addition, amorphous selenium photoconductors while producing line copy and other contrast originals in an excellent fashion have a relatively short dynamic range of about 0.6 density units when used in combination with conventional xerographic development processes, for example, cascade development The dynamic range of a particular xerographic plate and development system as used herein is intended to mean that range of original image densities which will produce a viewable change in the density of the reproduction produced by the plate where, density = D = log 1/R where R equals the ratio of reflected light to incident light. For example, in a very dense area of an original or reproduction where only one tenth of the incident light is reflected back to the eye of the viewer, R equals 1/10 and the log of 1/R, i.e., density, of course, would be 1. A density of 1.3 is where about 1/20 of the incident light is reflected back to the viewer. Practically, reflection densities anywhere from about 1.2 to 1.5 or above appear to the human eye as a very dense black. Thus, since generally it is thought that a given imaging system should have a dynamic range of about 1.2 or 1.5 or more to produce a quality toner reproduction, with a reasonably full latitude of contrast, it is seen that conventional amorphous selenium plate xerography has serious limitations in this regard.

Also, it has been found that cycled amorphous selenium photoconductors are preferably imaged with positive charge in that such photoconductors do not as reliably dissipate negative surface charge in exposed areas. The photoconductors of this invention may be charged to either polarity and be useful. This characteristic is called ambipolarity.

Electrically insulating organic binder xerographic plates containing zinc oxide and other pigments, on the other hand; while comparatively inexpensive are generally considered to be substantially unreusable. Furthermore, it is necessary to use such a high percentage of pigment in order to attain adequate sensitivity that it is difficult in zinc oxide plates to obtain smooth surfaces which would lend themselves to efficient toner transfer and efficient cleaning prior to reuse. For example, in a conventional zinc oxide binder layer zinc oxide pigment may comprise about ½ the layer by volume, the other half consisting of electrically insulating resin. This relatively high volume of pigment is required to provide an unbroken chain of pigment particles to transport the charge carriers. Also, at least as important is the photoconductive discharge characteristics change with cycling at practical rates such as exhibiting residual conductivity patterns of previous images and reduced charge acceptance levels. An additional drawback to use of the zinc oxide type plates is that generally they can be sensitized only by negative and not by positive corona, because the dark conductivity of positive charges is high.

U.S. Pat. No. 3,037,861 to H. Hoegl et al. shows a xerographic member made up of polyvinyl carbazole and teaches that polyvinyl carbazole exhibits some u.v. sensitivity. It also teaches that the spectral sensitivity of the polyvinyl carbazole may be extended into the visible spectrum by addition of dye sensitizers. The patent further suggests that other additives such as zinc oxide or titanium dioxide may also be used in conjunction with polyvinyl carbazole. It is clear from the patent that the intrinsic photoconductivity of the polyvinyl carbazole is intended to be used.

Thus, although some photoconductive insulators work well in xerography, there is a continuing need for better photoconductive insulating materials for use in fabricating xerographic plates for use in xerography. In particular, it would be extremely desirable to provide an organic binder type xerographic plate which may be sensitized with either polarity of charge, which is reusable, which has a relatively broad spectral response which has extended dynamic range and is relatively easy and inexpensive to manufacture, and which in addition possesses other desirable photoconductor properties.

SUMMARY OF THE INVENTION

It is, therefore, an object of this invention to provide a new photoconductive insulating material and processes for making and using the same which overcome the above noted disadvantages and satisfy the above noted wants.

It is a further object of this invention to provide a xerographic plate wherein the photoconductor preferably employs a relatively small percentage of a pigment material in an electrically insulating binder.

It is a further object of this invention to provide a xerographic plate which has a light sensitivity comparable to the best commercially available amorphous selenium xerographic plates and to provide improved continuous tone images.

It is a still further object of this invention to provide a xerographic plate which may be formulated from flexible binder systems suitable, for example, for use in web or endless belt type xerographic plate configurations.

It is a still further object of this invention to provide a photoconductor usable in the process of xerography which is compatible with a variety of sensitizing pigments which may be added to control sensitivity and spectral response.

It is a still further object of this invention to provide a pigment-binder photoconductor which is ambipolar and which may be used to reproduce positive images from positive or negative originals without changing the developer.

It is a still further object of this invention to provide a pigment-binder photoconductor which is recyclible in the process of xerography.

It is a still further object of this invention to provide a pigment-binder photoconductor which is relatively easy and inexpensive to make.

The foregoing objects and others are accomplished in accordance with the invention by providing a novel photoconductive insulating material comprising relatively low concentrations of two or more photoconductive pigments which can generate and inject both holes and electrons in response to imagewise radiation in an insulating binder which can transport holes and electrons during imagewise exposure, imaging members made therefrom and processes for using said members. It has been found that by dispersing relatively small particles of photoconductive pigments approximately 0.1 to about 2 microns in cross-section in an insulating binder so that the total pigment concentration ranges from about 2 parts to about 10 parts based on 100 parts binder by volume, preferably in the range of from about 4 to about 8 parts of photoconductive pigment based on 100 parts of binder by volume provide a photoconductor with excellent imaging characteristics for xerographic processes. It is desirable to use two or more pigments to broaden the dynamic range and spectral response and to make the shape of the discharge curve less dependent on the wavelengths of the imagewise illumination used. Higher concentrations of pigment associated with, for example, 15 to 50% by volume pigment appear to cause light fatigue and charge fatigue on recycling, presumably such detrimental effects are the results of change in the electrical behavior of the photoconductive pigment and not the binder.

In a particularly preferred embodiment of the present invention, the presence of from about ½ parts to about 5 parts by weight of CdSSe (cadmium sulfoselenide) in 100 parts of a binder provides a photoconductive layer with superb imaging characteristics when used in commercial recyclible xerography.

BRIEF DESCRIPTION OF THE DRAWINGS

The advantage of this novel photoconductive insulating material will become apparent upon consideration of the following detailed disclosure of the invention; especially when taken in conjunction with the accompanying drawings wherein:

Referring now to FIG. 1, there is illustrated xerographic plate 10 comprising a layer of the photoconductive insulator 14 of this invention overlying electrically conductive layer 12. In conventional xerography, the electrically conductive layer 12 is generally grounded during a charging step to facilitate the deposition of a uniform layer of charge upon layer 14. Charging of the plate 10 is readily accomplished in a variety of ways, for example, by rubbing layer 14 with a soft brush or fur or more preferably by utilizing corona charging techniques, for example, as described in Vyverberg U.S. Pat. No. 2,836,725 and Walkup U.S. Pat. No. 2,777,957. Charging is usually accomplished in the absence of activating radiation, i.e., that radiation which makes the photoconductive layer 14 relatively more electrically conductive in radiation struck plate portions. After charging, the next xerographic processing step is to expose the plate to a pattern of activating electromagnetic radiation thereby discharging light struck areas of the plate 10 relative to non-light struck areas thereby forming an electrostatic latent image on or in layer 14.

Thereafter the latent image is then made visible, i.e., developed, by contacting the latent image with toner, generally electrostatically charged to a polarity opposite to the polarity of the electrostatic latent image, causing the material to be held thereon in the pattern corresponding to the latent image.

Any suitable development system may be used to develop latent images on plates of this invention and many such systems exist in the art.

For example, the system of cascade development has found extensive commercial acceptance and generally consists of gravitationally flowing developer material consisting of two component materials of the type disclosed in Walkup et al. U.S. Pat. No. 2,638,416 over the xerographic plate bearing the latent image. The two components consist of toner and a granular material called "carrier" and which by mixing acquire tribolectric charges of oppositely charged to the latent image is deposited on the latent electrostatic image to render that image visible.

Typical developing systems include for example, processes shown in Carlson U.S. Pat. Nos. 2,221,776; 2,551,582; 2,690,394; 2,761,416; 2,928,575; Gundlach U.S. Pat. Nos. 3,068,115 and 3,084,043; Mayo U.S. Pat. No. 2,895,847; and others.

The powder image may then be transferred to another support surface to which it may be affixed by solvent vapors, heat or other suitable means to render the image indefinitely usable or the powder image may be affixed directly to the xerographic plate either as a result of developing or a separate step thereafter.

Layer 12 may be any suitable electrically conductive material, for example, most metals. Aluminum has been extensively commercially used as an electrically conductive backing member in the preparation of xerographic plates. However, other suitable materials for this purpose are steel, brass, metallized tin oxide coated glass, plastics, semi-conductive plastic resins, paper and any other convenient material.

Figure 1:
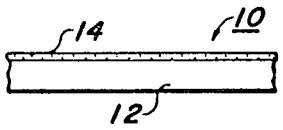
FIG. 1 depicts an embodiment of a typical xerographic plate employing the novel photoconductive insulating material of this invention.

Of course, xerographic plate configurations may be extensively varied beyond the rigid or flexible plate configuration shown in FIG. 1. The plate, may take the form of a rigid or flexible drum configuration or the form of a flexible endless belt in loop or moebius strip form or any other suitable form.

Referring now more particularly to layer 14 and the materials which comprise this layer. While it is not fully understood, it has been discovered that by dispersing a mixture of finely-divided photoconductive pigments, the mixture being capable of generating and injecting holes and electrons, into a binder the binder being capable of transporting both types of charge carriers in response to imagewise exposure an extended dynamic range photoreceptor is provided which has a dynamic range which is dependent on both the absorption coefficient and the thickness of the photoreceptor. It has also been discovered that by using a binder which is capable of generating and transporting both types of charge carriers at substantially zero electrical fields a highly recyclible plate is provided. These binder properties are required because the photoconductive pigments fail to inject charge below a field threshold which is unacceptable for recycling operations.

There are several mechanisms proposed which could explain the extension of the dynamic range. One possible mechanism is that two phenomena combine in a unique way. First the absorption coefficient for the actinic radiation is increased substantially reducing the penetration of actinic light into the photoreceptor. At the same time, trapping sites are increased to the point that the mean distance traveled by a charge carrier is reduced to a small fraction of the total thickness of the photoconductor.

This combination of properties uniquely permits the various levels of depth in the photoconductive layer to operate independently, and yet respond to widely different values of exposure. For example, a point 15 $\mu$ below the surface of a photoconductor having an absorption coefficient, $\alpha = 0.2\mu^{-1}$ will receive only 5% of the light incident at the top surface. Only by limiting the carrier range, can discharge of the uppermost levels take place without interfering with the independent discharge of the low layers taking place at a considerably reduced rate. The absorption coefficient $\alpha$ is obtained from the following relationship: $I = I_o e^{-\alpha t}$ wherein $I_o$ is the original intensity and $I$ is the intensity after passing through thickness $t$ of a layer those absorption coefficient is $\alpha$.

Another possible mechanism involves the use of photosensitive particles whose photogeneration and injection properties are strongly field dependent. Here it is speculated that the structure provides a relatively slow carrier transport as distinguished from carrier trapping during imaging exposure resulting in an internal field distribution which again has a lesser internal field near the surface of the photoconductor than at points further away from the surface. This field distribution coupled with the fact that the photogeneration and/or photoinjection properties of the particles are strongly field dependent provides a rapid reduction in effective photosensitivity as discharge progresses, giving rise to an extended dynamic range.

Either theory explains why, short of particle-to-particle contact, increased pigment ratios result in increased dynamic range. Also, predictably, increased photoconductor thickness has been found to increase the dynamic range of this new type of photoreceptor.

The absorption coefficient for the photoconductive members of this invention are at least 1/L and not more than 8/L where L is the photoconductor thickness in microns with an optimum being about 2/L to 4/L the preferred value being about 1/5. That is, for a 15 micron plate, a coefficient of 3/15 or about $0.2\mu^{-1}$ is desired.

The photoconductive members of this invention also have a mean charge carrier travel of from about 1/10 to ⅓ the photoconductor thickness, preferably about 1/5.

It was found that generally mixtures of pigments in binders produced a xerographic plate which showed a residual sensitivity pattern or sensitivity fatigue corresponding to recent previous exposures of the plate which resulted in a "ghost" image corresponding to prior exposures. In order to eliminate the sensitivity fatigue problem, it was necessary to dark rest the plate for several hours or to heat the plate to a temperature of 50° C for several minutes. It has been found, surprisingly, that CdSSe dispersed in an insulating organic binder capable of transporting holes and electrons, in any suitable weight ratio, preferably from about ½ parts to about 5 parts by weight to 100 parts binder produces a xerographic photoconductor layer which is simultaneously resistive, highly photosensitive, recyclible, ambipolar, exhibits low fatigue, is relatively panchromatic and exhibits a long dynamic range providing continuous tone imaging. It was found that the addition of CdSSe in the preferred range given above substantially reduced residual conductivity or photoconductivity patterns which were found to increase with cycling when CdSSe was not present and rendered the plate ambipolar as compared to photoconductive insulating layers without CdSSe. Without the CdSSe the plates are not recyclible to both polarities of charge because of ghost images.

Preferred insulating binders for use herein are organic resins sensitized to render them capable of transporting holes and electrons during imagewise exposure and be capable of generating and transporting holes and electrons at relatively high illumination but substantially zero electrical fields so that they may be completely discharged for reuse. A preferred binder comprises polyvinyl carbazole which alone will transport holes sensitized with about 10% by weight 2,4,7-trinitro-9-fluorenone which provides electron transport. The photosensitivity of the binder layer, that is, the ability to generate holes and/or electrons is not used during the preferred relatively low imagewise illumination of this invention. Imagewise exposure of not more than about $5 \times 10^{14}$ photons/cm$^2$ is preferred for the plates of this invention. Exposures above about $5 \times 10^{14}$ photons/cm$^2$ are impractical in a fast cycling machine. This imagewise exposure will not cause substantial generating holes and electrons in the insulating binder. The erase lamp which totally discharges the plate, for example to prepare the layer for another imaging cycle, provides typically a flood illumination exposure preferably at least about 10 times higher than the imagewise illumination.

At these limitation levels and at the low fields associated with the erase steps, the insulating binder may generate sufficient holes and electrons to substantially assist in the erase step. Other suitable resin binder materials are those having the sensitizer 2,5-bis (p-N,dimethylaminophenyl)-1,3,4-oxadiazole, available under the designation TO 1920 from Kalle & Co., Wiesbaden-Biebrich, Germany in resin binder materials, such as VYNS, VYLF and VYNW which are vinylchloride-vinylacetate copolymers available from Union Carbide. The TO 1920 sensitizer may be present in a concentration from about 10 to 70 weight percent, with a concentration of 50 weight percent being preferred. The layer may be prepared, for example, with tetrachlorophthalic anhydride as described in the Examples. Another suitable binder comprises polycarbonate resin. A typical polycarbonate comprises one available under the tradename Lexan from General Electric. The polycarbonate is sensitized with triphenylamine and 2,4,7-trinito-9-fluorenone in a concentration of up to about 50 weight percent equal amounts (25%) of each sensitizer provides satisfactory results.

However, any suitable electrically insulating material may be used which can be sensitized to form binders meeting the above requirements. In order to be useful, the organic resin material used must be more resistant than about $10^{10}$ and preferably more than about $10^{12}$ ohm-cm, under the conditions of xerographic use.

The pigments may be incorporated in insulating binders typically by incorporating them in a dissolved or melted sensitized binder material by any suitable means such as ball milling. These methods also include strong shear agitation, preferably with simultaneous grinding, roller milling, sand milling, ultrasonic agitation, high speed blending and any desirable combination of these methods.

The pigment-binder solvent dispersion slurry (or the pigment-binder-melt) may be applied to substrates by any of the well known painting or coating methods including spray coating, flow coating, knife coating, electro coating, Mayer bar draw down, dip coating, reversal coating and so on. Spraying in an electric field may be preferred for smoothest finish and dip coating for convenience in the laboratory. The setting, drying and/or curing steps for these plates are generally similar to those recommended for films of the particular binders used for the other painting applications.

The thickness of the photoconductor layer of this invention for use in xerography may be varied from about 2 to about 50 microns depending on the required individual needs. Self-supporting films, for example, cannot usually be manufactured in thicknesses thinner than about 10 microns, and are easiest to handle and use in the above 15 micron range. Coatings of this invention, on the other hand, are preferably in the 5 to 50 micron range. The photoconductive layer of this invention may comprise any suitable photoresponsive particulate material dispersed in a binder. Typical pigments include organic materials such as quinacridones, carboxamides, carboxanilides, triazines, benzopyrrocolines, anthraquinones, azos, pyrenes, phthalocyanines and inorganic materials such as cadmium sulfide, zine oxide, lead sulfide, sulphur, selenium, mercuric sulfide, lead oxide, lead sulfide, cadmium selenide, titanium dioxide, indium trioxide and mixtures thereof.

The preferred composition for layer 14 comprises from about ½ to about 5 parts by weight cadmiumsulfoselenide, from about ½ to about 5 parts by weight phthalocyanine and from about 1 to about 5 parts by weight selenium dispersed in about 100 parts of an insulating binder of polyvinylcarbazole sensitized with about 10 percent by weight trinitrofluorenone. The total of the CdSSe, phthalocyanine and selenium should not exceed about 15 parts by weight based on 100 parts of photoconductive binder to provide all of the advantages of this invention.

It has been found that when the concentration of the CdSSe is above about ½ parts by weight, or below about 10 parts by weight the plate is ambipolar, has excellent recyclible properties, and ghost images are reduced. By amipolar is meant that the plate may be recycled when charged to either polarity.

When layer 14 contains more than about ½ part by weight phthalocyanine, the plate has increased sensitivity to red light. When layer 14 contains up to about 3 parts by weight of phthalocyanine, the plate is ambipolar, is recyclible showing little or no charge fatigue and is able to produce a high quality continuous-tone image.

When layer 14 contains more than about one percent by weight of selenium, the plate has increased sensitivity to blue light, and is ambipolar. When up to about 8 parts by weight selenium is present in layer 14, the plate is recyclible showing little or no charge fatigue and is ambipolar.

About 5 percent to about 15 percent of 2,4,7-trinitro-9-fluorenone in the binder is preferred since above about 5 percent of trinitrofluorenone the plate is recyclible showing little or no residual charge build up. Up to about 15 percent of trinitrofluorenone provides a recyclible plate having excellent charge acceptance.

Figure 2:
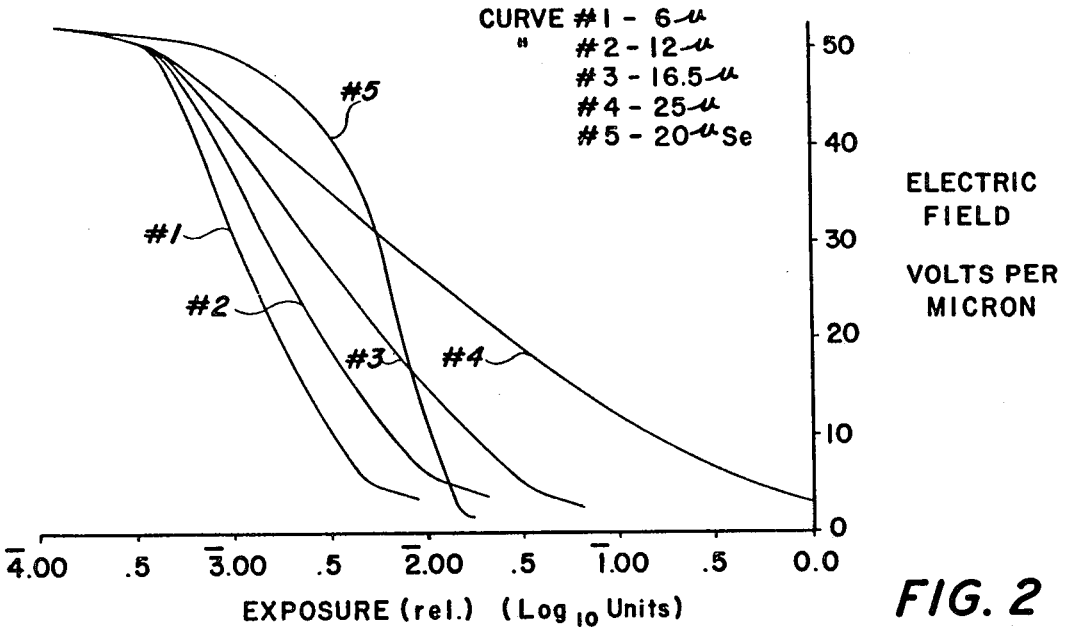
FIG. 2 is a graph comparing the discharge curves for selenium and a preferred embodiment of this invention.

Referring now to FIG. 2, there is shown a graph which compares the discharge curves of four plates of this invention having differing thicknesses and a selenium plate.

The test results plotted on the graph are obtained by charging the photoconductor initially to 50 volts per micron by photoconductor thickness, that is, the plate of curve 5 would be charged to a potential of $25 \times 50 = 1250$ volts. Using collimated (parallel) light, the photoconductors were exposed to a neutral density wedge (linear from a density of 0.0 to 3.0 over 10 centimeters available from Eastman Kodak Research Laboratories of Rochester, New York). The exposed area of the photoconductor is then read by a recording electrometer which gives a plot of potential vs. $\log_{10}$ exposure.

The graph shows that the plates of this invention have a brightness acceptance range which is considerably greater than selenium. Similar tests have shown the brightness acceptance range of the photoconductors of this invention to also be greater than that for selenium alloys.

The curves show that the photoconductive plates of this invention are eminently more useful for producing continuous tone images than selenium. It has also been found that the brightness acceptance range of the plates of this invention vary with the thickness of the plates. An empirical equation has been derived for the preferred formulation which shows that $\Delta D_o = 0.65 + 0.1t$ where $\Delta D_o$ is the dynamic range and T is the plate thickness in microns. This is not true of selenium and its alloys providing a further control over the results obtainable with the plates of this invention.

Figure 3:
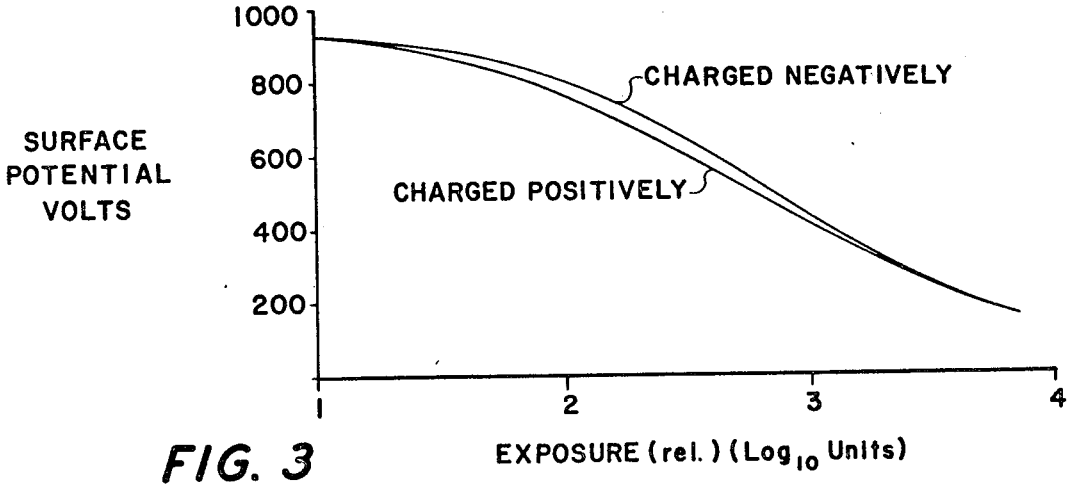
FIG. 3 is a graph showing the response of a preferred photoreceptor of this invention when charged positively or negatively.

FIG. 3 shows the high degree of ambipolarity obtainable in accordance with this invention. The curve is obtained by charging and exposing as was done for FIG. 2. The curve shows the response of the plates charged both positively and negatively to the amount of light exposure. A major advantage of ambipolarity is that the image sense of an image can be reversed, that is, a positive image may be produced from either a positive or a negative original by merely changing the sign of the potential of the charging corotron. Prior art processes such as those shown in U.S. Pat. No. 2,914,403 to Sugarman, U.S. Pat. No. 2,986,521 to Wielicki and U.S. Pat. No. 3,013,890 to Bixby rely on the triboelectric relationship between the carrier and toner particles which make up the developer or on two-stage development processes. This means that either the developer had to be changed or a much more complex imaging process was required.

It has also been found that the preferred plates of this invention can be recycled every 4 seconds without serious change in charge acceptance, brightness acceptance range, residual voltage and without image ghosting.

DESCRIPTION OF THE PREFERRED EMBODIMENTS

The following Examples further specifically define the surprisingly advantageous photoconductive insulating material of this invention. The parts and percentages are by weight unless otherwise indicated.

The Examples below are intended to illustrate various preferred embodiments of the improved photoconductive insulating material of this invention.

The photoconductive members of Examples 1–21 shown in Table I of this invention are made as follows:

A 1/1 mix of cyclohexanone and toluene is prepared. About 100 parts by weight of polyvinylcarbazole is dissolved in about 560 parts by weight of the cyclohexanone-toluene mix. The dissolving rate may be increased by heating. The solution is then placed in a milling jar and the desired amount of CdSSe, phthalocyanine, selenium and 2,4,7-trinitrofluorenone are added. The materials are milled by rotating the jar until the particles of CdSSe, phthalocyanine and selenium have a particle size of less than about one micron. The 2,4,7-trinitro-9-fluorenone forms a complex with the polyvinylcarbazole. The slurry is coated onto a clean Xerox 914 Copier aluminum drum to produce a thickness of 15 microns when dried. Drying is accomplished using forced air at 75° C in about an hour. The drum is then placed in a Xerox 914 Copier for testing. The photoconductive members shown in Examples 19–21 are made as follows:

About 100 parts of VYNS and 10 parts TO 1920 are dissolved in about 800 parts of a mixture of 30% cyclohexanone and 70% 3-pentanone. The desired amount of pigment is then added to the solution, placed in a milling jar, the jar being rotated until the particles have a particle size of less than about one micron. The plates are then tested in a Xerox 914 Copier. Either crystalline or amorphous selenium may be used.

The phthalocyanine is preferably metal-free and in either the beta or X polymorphic forms prepared as shown in U.S. Pat. No. 3,357,989 to Byrne et al. The cadmiumsulfoselenide is available as 1020 Red Pigment from General Color Co., Fort Wayne, Ind.

In the Examples shown in Table I, the parts given are parts by weight based on 100 parts by weight polyvinylcarbazole. Unless otherwise indicated, about 10 parts by weight of trinitrofluorenone based on 100 parts by weight of polyvinylcarbazole (PVK) is added to the mix.

TABLE I

| 1 Example No. | 2 Parts CdSSe | 3 Parts Se | 4 Parts Phthalo | 5 Recycli-bility | 6 Ambi-polarity | 7 Ghost Images | 8 Continuous Tone |
|---|---|---|---|---|---|---|---|
| 1 | 0 | 5 | 1 | 2 | 4 | 1 | 7 |
| 2 | ½ | 5 | 1 | 2 | 4 | 2 | 7 |
| 3 | 1 | 5 | 1 | 3 | 6 | 6 | 7 |
| 4 | 2 | 5 | 1 | 6 | 7 | 8 | 8 |
| 5 | 3 | 5 | 1 | 10 | 10 | 10 | 10 |
| 6 | 5 | 5 | 1 | 7 | 8 | 10 | 9 |
| 7 | 7 | 5 | 1 | 2 | 6 | 10 | 6 |
| 8 | 3 | 0 | 1 | 6 | 8 | 10 | 8 |
| 9 | 3 | 1 | 1 | 7 | 10 | 10 | 8 |
| 10 | 3 | 2½ | 1 | 8 | 10 | 10 | 9 |
| 11 | 3 | 10 | 1 | 4 | 6 | 10 | 5 |
| 12 | 3 | 20 | 1 | 2 | 2 | 10 | 3 |
| 13 | 3 | 5 | 0 | 7 | 8 | 10 | 5 |
| 14 | 3 | 5 | ½ | 4 | 8 | 10 | 7 |
| 15 | 3 | 5 | 2½ | 8 | 10 | 10 | 7 |
| 16 | 3 | 5 | 5 | 5 | 4 | 8 | 4 |
| 17 | 3 | 5 | 10 | 1 | 2 | 4 | 1 |
| 18 | 3 | 2½ | 1 | 8 | 10 | 10 | 9 |
| 19 | 3 | 0 | 0 | 9 | 5 | 9 | 8 |
| 20 | 0 | 5 | 0 | 8 | 7 | 8 | 7 |
| 21 | 0 | 0 | 1 | 1 | 5 | 1 | 8 |

TABLE II

| 1 Example No. | 2 Parts CdSSe | 3 Parts $TiO_2$ | 4 Parts Phthalo | 5 Recyli-bility | 6 Ambi-polarity | 7 Ghost Images | 8 Continuous Tone |
|---|---|---|---|---|---|---|---|
| 1 | 0 | 5 | 1 | 2 | 4 | 1 | 8 |
| 2 | ½ | 5 | 1 | 2 | 4 | 2 | 8 |
| 3 | 1 | 5 | 1 | 3 | 6 | 6 | 8 |

TABLE II-continued

| 1 Example No. | 2 Parts CdSSe | 3 Parts $TiO_2$ | 4 Parts Phthalo | 5 Recyli-bility | 6 Ambi-polarity | 7 Ghost Images | 8 Continuous Tone |
|---|---|---|---|---|---|---|---|
| 4 | 5 | 5 | 1 | 7 | 8 | 10 | 10 |
| 5 | 7 | 5 | 1 | 2 | 6 | 10 | 7 |
| 6 | 3 | 1 | 1 | 7 | 10 | 10 | 9 |
| 7 | 3 | 2½ | 1 | 8 | 10 | 10 | 10 |
| 8 | 3 | 5 | ½ | 4 | 8 | 10 | 8 |
| 9 | 3 | 5 | 2½ | 8 | 10 | 10 | 8 |
| 10 | 3 | 5 | 5 | 5 | 4 | 8 | 5 |
| 11 | 3 | 10 | 1 | 4 | 6 | 10 | 5 |
| 12 | 3 | 0 | 1 | 6 | 8 | 10 | 8 |

In Table I, the first column is the Experiment number. The second-fourth columns are the parts of cadmiumsulfoselenide, selenium and phthalocyanine ("X"-form) based on 100 parts of polyvinylcarbazole in the photoconductive layer. Column 5, recyclibility, represents the qualities of the photoconductors which make it useful as a reusable photoconductor and represents fatigue, dark decay, charge acceptance and residual potential. The photoconductors are given a rating of from 1 to 10 with 10 representing the plates having the best recyclible characteristics. For example, the drum of Example 5 was used to make 40,000 copies at a rate of 15 copies per minute with no decrease in image quality. By way of further example, a plate having a rating of less than 5 although suitable for manual use is not useful in a reusable plate machine in that the plates require a rest period and/or heating between cycles to restore photoconductive properties. A plate having a rating of from 5 to 7 requires about 3 minutes between cycles but can be used at a faster rate if a uniform negative charge is applied to the plate between cycles. A rating of from 8 to 10 indicates that the plates are good enough to be used in a rapid continuous imaging machine environment such as the Xerox 720, 914 and 2400 copiers.

Column 6 is an evaluation of the ambipolarity characteristic again being given a rating of from 1 to 10 with the best plates showing no appreciable difference in recyclibility, ghosting or quality of continuous tone images when charged to either polarity. A rating of less than 5 indicates that the plates vary by a factor of four or more in their light sensitivity depending on whether they are charged negatively or positively.

Column 7 is an evaluation again rated from 1 to 10 of the quality of the images formed in regard to whether a "ghost" of a previous image is formed which is evidence of residual conductivity or photoconductivity. The plates rated from 8 to 10 have no visible ghost even when exposed to intense radiation. A rating of from 5 to 7 indicates that ghosting can be eliminated if the plate is rested and/or heated. A rating of four or less indicates that a ghost persists indefinitely which results from attack on the plate.

Column 8 is an evaluation based on a rating of from 1–10 of the ability of the photoconductor to make high quality continuous tone images. The rating is arbitrary with the best plates having a rating of from 8 to 10. A rating of from 5–7 indicates marginal images. A rating of from 1–4 indicates unacceptable continuous tone imaging.

Table II is similar to Table I except that column 3 represents the titanium dioxide content of the photoreceptor. The binder is the same as that used in Examples 1 through 21 and the photoconductors are made and tested as in those Examples. It should be pointed out that the plates of Table II are not quite as panchromatic as the plates of Table I containing Se nor are quite as sensitive.

Although specific components are proportions have been stated in the above description of the preferred embodiments of the invention, other suitable materials as listed herein may be used with similar results. In addition, other materials may be added to materials used in order to synergize or enhance or otherwise modify the properties of the novel photoconductive layer of this invention. For example, if desired, the spectral response of the novel photoconductive layers of this invention may be further modified by including photosensitizing dyes.

Also, after formation of the electrostatic latent image on the photosensitive layers of this invention, the image may be utilized in numerous ways. One typical utilization made is rendering the image visible by the xerographic development techniques of contacting the latent image areas with a finely divided marking material called toner that is brought into surface contact with the surface of the plate and is held there electrostatically in a pattern corresponding to the electrostatic latent image. Cascade development, for example, as disclosed in Walkup et al. U.S. Pat. No. 2,638,416 as well as any other suitable mode of bringing toner into contact with the electrostatic latent image known to those skilled in the art of xerography may be used herein.

Another mode of utilizing the electrostatic latent images formed on the imaging members hereof is to transfer the charge pattern to another layer by bringing the two layers into very close proximity and utilizing breakdown techniques as described, for example, in Carlson U.S. Pat. No. 2,982,647 and Walkup U.S. Pat. Nos. 2,825,814 and 2,937,943. For example, the layer to which the charge image is transferred may be a surface deformable material which may be caused to deform in image configuration as disclosed in Gunther et al. U.S. Pat. No. 3,196,011.

The electrostatic latent image may also be directly read out utilizing devices such as electrometers which detect potential differences which may be translated into giving the graphic information that was represented by the original electrostatic latent image.

Insulating receiving sheets may be brought into contact with the electrostatic latent image bearing plates hereof and the receiving sheet developed with toner utilizing techniques which permit a plurality of such copies to be made from one master electrostatic latent image.

As disclosed in copending application Ser. No. 867,049, filed Oct. 16, 1969 relatively more conductive image receiving sheets including paper may be placed in contact with the electrostatic latent image bearing plates hereof inducing an image in said receiving sheet which induced image can be developed by techniques which permit 100 or more such developed receiving sheets to be made from a single master electrostatic latent image.

It will be understood that various other changes in the details, materials and steps which have been herein described and illustrated in order to explain the nature of this invention will occur to and may be made by those skilled in the art upon a reading of this disclosure and such changes are intended to be included within the principle and scope of this invention.

What is claimed is:

1. A photoconductive layer having improved recycling properties for use in a recycling xerographic process, said layer having a mixture of at least two photoconductive pigments dispersed in a binder, said photoconductive pigments being present in a combined concentration of up to about 15 parts by weight based on 100 parts by weight of a binder, the improvement which comprises one of said photoconductive pigments consisting essentially of cadmium sulfoselenide in a concentration of about ½ to 5 parts by weight based on 100 parts by weight of said binder, said photoconductive pigments being present as particles, said mixture of photoconductive pigments being capable of generating and injecting holes and electrons in response to imagewise radiation of not greater than about $5 \times 10^{14}$ photons/cm$^2$, said binder being selected from the group consisting of a vinylchloride-vinylacetate copolymer sensitized with 2,5-bis(p-N,-dimethylaminophenyl)-1,3,4-oxadiazole; a polycarbonate resin sensitized with 2,4,7-trinitro-9-fluorenone, and polyvinylcarbazole sensitized with 2,4,7-trinitro-9-fluorenone, said binder being capable of transporting holes and electrons during exposure to said imagewise radiation but being incapable of generating holes and electrons sufficient to contribute substantially to formation of an electrostatic image during said imagewise exposure, said binder being capable of generating and transporting holes and electrons during exposure to wavelengths of radiation to which said binder is sensitive at an illumination level of more than about $5 \times 10^{15}$ photons/cm$^2$ at substantially zero electrical field to cause discharging of said photoconductive layer sufficiently to allow recycling of said photoconductive layer in a recycling xerographic process.

2. The photoconductive layer of claim 1 wherein the binder is polyvinylcarbazole sensitized with 2,4,7-trinitro-9-fluorenone.

3. The photoconductive layer of claim 1 wherein one of the photoconductive pigments is selenium present in about 1 to 5 parts by weight based on the total weight of the binder.

4. The photoconductive layer of claim 3 wherein the binder is polyvinylcarbazole sensitized with 2,4,7-trinitro-9-fluorenone.

5. The photoconductive layer of claim 1 wherein one of the photoconductive pigments is phthocyanine present in about ½ to about 5 parts by weight based on the total weight of the binder.

6. The photoconductive layer of claim 5 wherein one of the photoconductive pigments is selenium present in about 1 to about 5 parts by weight based on the total weight of the binder.

7. The photoconductive layer of claim 6 wherein the binder is polyvinylcarbazole sensitized with 2,4,7-trinitro-9-fluorenone.

8. A method of imaging which comprises:

a. electrically charging the photoconductive layer of claim 1;

b. exposing said layer to a pattern of radiation of illumination not greater than $5 \times 10^{14}$ photons/cm$^2$ to cause said photoconductive particles to generate and inject holes and electrons and to cause said binder to transport holes and electrons but insufficient to cause said binder to generate holes and electrons which can contribute substantially to formation of an electrostatic image until an electrostatic image is formed.

9. The method of claim 8 and further including the step of:

c. exposing said layer to radiation of wavelengths to which said binder is sensitive of an illumination level of more than about $5 \times 10^{15}$ photons/cm$^2$ to cause said binder to generate holes and electrons at substantially zero electrical fields.

* * * * *